US009688505B2

(12) United States Patent
Yamaguchi et al.

(10) Patent No.: US 9,688,505 B2
(45) Date of Patent: Jun. 27, 2017

(54) FILAMENT WINDING METHOD AND FILAMENT WINDING APPARATUS

(71) Applicants: JTEKT Corporation, Osaka-shi (JP); TOYOTA JIDOSHA KABUSHIKI KAISHA, Toyota-shi (JP)

(72) Inventors: Yuji Yamaguchi, Toyokawa (JP); Hisaki Kojima, Kariya (JP); Tadashi Ohtani, Anjyo (JP); Takeshi Fujii, Obu (JP)

(73) Assignees: JTEKT Corporation, Osaka-shi (JP); TOYOTA JIDOSHA KABUSHIKI KAISHA, Toyota-shi (JP)

( * ) Notice: Subject to any disclaimer, the term of this patent is extended or adjusted under 35 U.S.C. 154(b) by 377 days.

(21) Appl. No.: 14/332,769

(22) Filed: Jul. 16, 2014

(65) Prior Publication Data

US 2015/0021425 A1 Jan. 22, 2015

(30) Foreign Application Priority Data

Jul. 16, 2013 (JP) ..... 2013-147360

(51) Int. Cl.
*B65H 59/38* (2006.01)
*B65H 59/36* (2006.01)

(52) U.S. Cl.
CPC ..... *B65H 59/387* (2013.01); *B65H 59/36* (2013.01)

(58) Field of Classification Search
CPC ..... B65H 59/36; B65H 59/387; B65H 23/00
See application file for complete search history.

(56) References Cited

U.S. PATENT DOCUMENTS

2012/0292422 A1 11/2012 Bonneville et al.

FOREIGN PATENT DOCUMENTS

| | | | |
|---|---|---|---|
| DE | 37 02 702 | A1 | 9/1987 |
| EP | 2 514 697 | A2 | 10/2012 |
| JP | 2005-262595 | A | 9/2005 |
| JP | 2007-161449 | A | 6/2007 |
| JP | 2009-66917 | | 4/2009 |

OTHER PUBLICATIONS

Extended Search Report issued Dec. 1, 2014 in European Patent Application No. 14177250.9.

*Primary Examiner* — William E Dondero
(74) *Attorney, Agent, or Firm* — Oblon, McClelland, Maier & Neustadt, L.L.P.

(57) ABSTRACT

Provided are a filament winding method and a filament winding apparatus, in which, when a new bobbin is mounted on a bobbin rotation driving device, the control device is programmed to rotate the bobbin and oscillate a dancer while maintaining a state where a distal end of filament unwound through the dancer is fixed further beyond the dancer and the filament is stretched. The control device is programmed to obtain a bobbin diameter of the bobbin mounted on the bobbin rotation driving device based on a length of the dancer, an oscillation angle of the dancer, and a rotation angle of the bobbin.

9 Claims, 6 Drawing Sheets

FILAMENT WINDING METHOD AND FILAMENT WINDING APPARATUS

INCORPORATION BY REFERENCE

The disclosure of Japanese Patent Application No. 2013-147360 filed on Jul. 16, 2013 including the specification, drawings and abstract is incorporated herein by reference in its entirety.

BACKGROUND OF THE INVENTION

1. Field of the Invention

The invention relates to a filament winding method and a filament winding apparatus, by which filament such as ceramic fiber, glass fiber, and carbon fiber is unwound from a bobbin upon which the filament is wound.

2. Description of Related Art

In recent years, a method for forming a reinforcing fiber preform has been widely used, in which filament made by impregnating ceramic fiber, glass fiber, carbon fiber, or the like into a resin or the like is unwound at certain tension from a bobbin upon which the filament is wound, and the unwound filament is wound on an object to be wound upon. Also, a filament winding apparatus is used as an apparatus for unwinding the filament from the bobbin at certain tension. For example, as shown in FIG. 5, Japanese Patent Application Publication No. 2005-262595 (JP 2005-262595 A) discloses a filament winding apparatus 100 including a bobbin moving mechanism 170 that is able to change relative positions of a bobbin 110 and a guide roller 141, and the filament winding apparatus 100 is able to maintain certain tension of unwound filament adequately even when the filament is unwound at high speed. In FIG. 5, reference numerals 141 to 146 denote guide rollers. Control means 160 controls an active dancer device 130A having an active dancer unit 151 and a dancer 130 based on detection signals from a tension sensor 140A and a speed sensor 140B to maintain the certain tension of the unwound filament, and controls the bobbin moving mechanism 170 to move the bobbin 110 to an appropriate position in an axis direction. Also, for example, Japanese Patent Application Publication No. 2007-161449 (JP 2007-161449 A) discloses a thread winding apparatus and a thread winding method by which a thread is wound on a bobbin. For detail, a thread winding apparatus and a thread winding method are disclosed, in which rotation speed of a package driving motor for driving a bobbin to rotate is changed between before and after a diameter of the bobbin, which has wound up a thread, reaches a given limit diameter. Thus, a single wind ratio is maintained from start to end of winding. A diameter of a point of the thread wound on the bobbin is detected by winding bobbin diameter detecting means that detects an oscillation angle of a cradle that holds the bobbin.

SUMMARY OF THE INVENTION

In a state where filament is unwound from a bobbin on which the filament is wound, a filament winding apparatus obtains a bobbin diameter, which is a diameter of a point of the filament wound on the bobbin, as necessary from speed of unwound filament and rotation speed of the bobbin, and displays a remaining amount of the filament and so on. However, when a new bobbin is mounted on the filament winding apparatus, filament is not unwound yet. Therefore, it is not possible to detect unwinding speed and rotation speed of the bobbin and it is thus impossible to obtain a bobbin diameter. Therefore, conventionally, when a new bobbin is mounted on the filament winding apparatus, an operator uses a caliper or the like to measure a bobbin diameter, which is a diameter of a point where filament is wound on the bobbin, and the operator then inputs the initial bobbin diameter in the filament winding apparatus. Based on the inputted initial bobbin diameter, the filament winding apparatus displays a remaining amount of the filament on the mounted bobbin, sets initial parameters for control of rotation speed of the bobbin and tension control of an active dancer when unwinding of the filament starts, and so on. In JP 2005-262595 A, since there is no description regarding measurement of a bobbin diameter when a new bobbin is mounted on a filament winding apparatus, an operator needs to obtain a bobbin diameter by using a caliper or the like. Manual measurement of a bobbin diameter by an operator is not preferred because a burden is imposed on the operator and measurement results vary. In JP 2007-161449 A, the winding bobbin diameter detecting means is provided to detect a bobbin diameter. By applying the winding bobbin diameter detecting means to a filament winding apparatus, the operator's work for measuring a bobbin diameter by using a caliper or the like is eliminated. However, since it is necessary to mount the winding bobbin diameter detecting means on an appropriate position in the filament winding apparatus, efforts, time and costs are required, which is not preferred. It is the object of the invention to provide a filament winding method and a filament winding apparatus, by which a bobbin diameter, which is a diameter of a bobbin at a point where filament is wound, is detected automatically when a new bobbin is mounted, without newly adding a bobbin diameter detection device.

First of all, a first aspect of the invention is a filament winding method using a bobbin rotation driving device, on which a bobbin, upon which filament is wound, is mounted, the bobbin rotation driving device driving and rotating the bobbin, a dancer that oscillates in order to apply certain tension to the filament unwound from the bobbin, and a control device that is programmed to control the bobbin rotation driving device.

When a new bobbin is mounted on the bobbin rotation driving device, the control device is programmed to rotate the bobbin and oscillate the dancer while maintaining a state where a distal end of the filament unwound through the dancer is fixed further beyond the dancer and the unwound filament is stretched. The control device is programmed to obtain a bobbin diameter of the bobbin mounted on the bobbin rotation driving device based on a length of the dancer, an oscillation angle of the dancer, and a rotation angle of the bobbin.

In the first aspect, when a new bobbin is mounted, the bobbin is rotated to oscillate the dancer while maintaining a state where the distal end of the filament unwound through the dancer is fixed further beyond the dancer and the filament is stretched. The bobbin diameter is then obtained based on the length of the dancer, the oscillation angle of the dancer, and the rotation angle of the bobbin. Thus, it is not necessary to newly add a bobbin diameter detection device. When a new bobbin is mounted, it is possible to automatically detect the bobbin diameter, which is a bobbin diameter at a point where the filament is wound.

In the filament winding method according to the above-stated first aspect, when the bobbin diameter is obtained, the dancer may be oscillated from one end or the vicinity of the one end of an oscillation range to the other end or the vicinity of the other end of the oscillation range.

In this method, when the bobbin diameter is obtained, the dancer is oscillated from one end (or the vicinity of the one end) of the oscillation range to the other end (or the vicinity of the other end) of the oscillation range. Thus, the dancer is oscillated as widely as possible, and it is thus possible to obtain the bobbin diameter more accurately.

In the filament winding method according to the first aspect, the control device may be programmed to automatically carry out at least either display of a remaining amount of the filament, or setting of an initial parameter when unwinding by the bobbin rotation driving device begins, based on the bobbin diameter obtained.

In this method, when a new bobbin is mounted, processing based on the measured bobbin diameter is carried out automatically based on measurement of the bobbin diameter at a point when the bobbin is mounted. Therefore, efforts and time required by an operator is reduced, and operations for forming a reinforcing fiber preform are carried out more effectively. Compared to the related art in which an operator measures the bobbin diameter by using a caliper or the like, a reduction in variation of measured bobbin diameters, and an improvement in accuracy of measured bobbin diameters are expected. At the same time, since it is not necessary to newly add a bobbin diameter detection device, it is possible to suppress an increase in costs.

Next, a second aspect of the invention is a filament winding apparatus that includes a bobbin rotation driving device, on which a bobbin, upon which filament is wound, is mounted, the bobbin rotation driving device driving and rotating the bobbin, a rotation angle detection device that detects a rotation angle of the bobbin rotation driving device, a dancer that oscillates in order to apply certain tension to the filament unwound from the bobbin, an oscillation angle detection device that detects an oscillation angle of the dancer, and a control device that is programmed to control the bobbin rotation driving device. In the filament winding apparatus, when a new bobbin is mounted on the bobbin rotation driving device, while maintaining a state where a distal end of the filament unwound through the dancer is fixed further beyond the dancer and the unwound filament is stretched, the control device is programmed to rotate the bobbin and oscillate the dancer. The control device is programmed to calculate a bobbin diameter of the bobbin mounted on the bobbin rotation driving device based on a rotation angle of the bobbin rotation driving device based on a detection signal from the rotation angle detection device, an oscillation angle of the dancer based on a detection signal from the oscillation angle detection device, and a length of the dancer.

In the above-stated second aspect, similarly to the first aspect, when the new bobbin is mounted, the bobbin is rotated to oscillate the dancer while maintaining the state where the distal end of the filament unwound through the dancer is fixed further beyond the dancer and the filament is stretched, and the bobbin diameter is obtained based on the length of the dancer, the oscillation angle of the dancer, and the rotation angle of the bobbin, Thus, it is not necessary to newly add a bobbin diameter detection device, and a filament winding apparatus is realized, which is able to automatically detect the bobbin diameter, which is a bobbin diameter at a point where the filament is wound, when a new bobbin is mounted.

In the filament winding apparatus according to the second aspect, when obtaining the bobbin diameter, the control device may be programmed to control the bobbin rotation driving device while taking in the detection signal from the oscillation angle detection device, and oscillate the dancer from one end or the vicinity of the one end of an oscillation range to the other end or the vicinity of the other end of the oscillation range.

With this construction, when the bobbin diameter is obtained, the dancer is oscillated from one end (or the vicinity of the one end) of the oscillation range to the other end (or the vicinity of the other end) of the oscillation range. Thus, the filament winding apparatus is realized, in which the dancer is oscillated as widely as possible, and it is thus possible to obtain the bobbin diameter more accurately.

In the filament winding apparatus according to the above-stated second aspect, the control device may be programmed to automatically carry out at least either display of a remaining amount of the filament, or setting of an initial parameter when unwinding by the bobbin rotation driving device begins, based on the calculated bobbin diameter.

With this construction, processing based on the measured bobbin diameter is carried out automatically based on measurement of the bobbin diameter at a point when the bobbin is mounted. Therefore, the filament winding apparatus is realized, in which efforts and time required by an operator is reduced, operations for forming a reinforcing fiber preform are carried out more effectively, a reduction in variation of measured bobbin diameters and an improvement in accuracy of measured bobbin diameters are expected, and a cost increase is suppressed.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

A mode for carrying out the invention is explained below by using the drawings.

Figure 1:
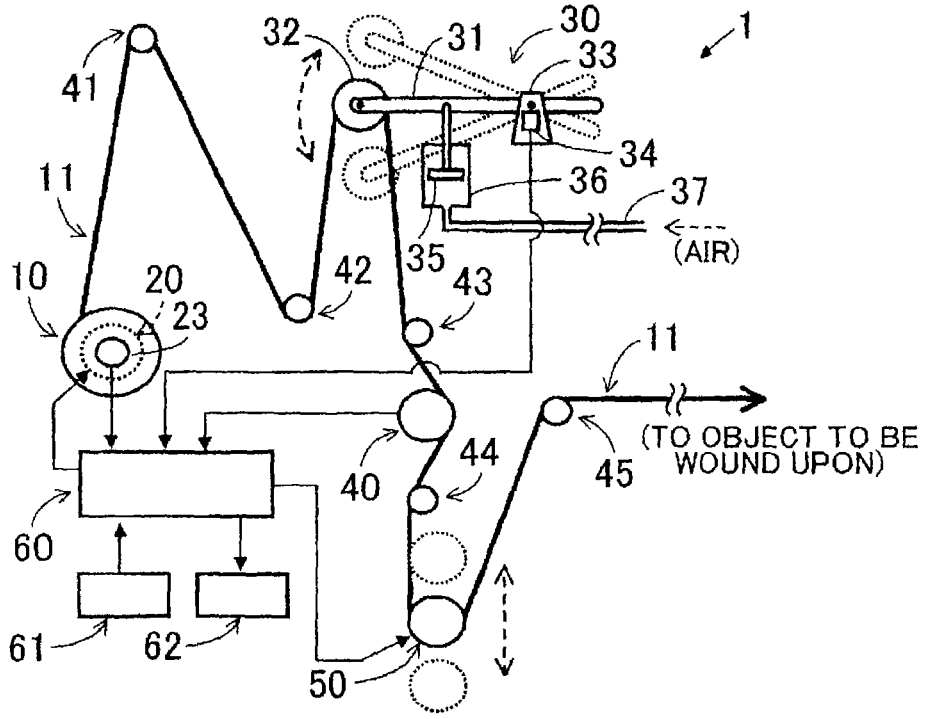
FIG. 1 is a view explaining an example of an overall structure of a filament winding apparatus according to the invention.

First of all, an overall structure of a filament winding apparatus 1 is explained by using FIG. 1. The filament winding apparatus 1 is provided with a bobbin rotation driving device 20, guide rollers 41 to 45, a dancer 30, a measuring roller 40, an active dancer roller 50, a control device 60, an input device 61, a display device 62 and so on. The filament is linear fiber such as ceramic fiber, glass fiber, and carbon impregnated in a resin.

The bobbin rotation driving device 20 is, for example, an electric motor. A bobbin 10, on which the filament is wound, is mounted on the bobbin rotation driving device 20. The bobbin rotation driving device 20 is driven by a control signal from the control device 60 and rotates the mounted bobbin 10. Rotation speed, a rotation angle, and so on are outputted from a rotation detection device 23 such as an encoder (an example of a rotation angle detection device) to the control device 60. Filament 11 unwound from the bobbin 10 goes through the guide roller 41 and the guide roller 42, is hung on a dancer roller 32 of the dancer 30, Then, the filament 11 passes through the guide roller 43 and is hung on the measuring roller 40. The filament 11 then passes through the guide roller 44, is hung on the active dancer roller 50, and is supplied to an object to be wound upon through the guide roller 45. Then, the filament 11 is wound on the object to be wound upon, thereby forming a reinforcing fiber preform.

The dancer 30 is a tension regulating device, and is structured of a dancer arm 31, a dancer roller 32, a support member 33, an oscillation angle detection device 34, a piston 35, an air cylinder 36, an air pipe 37, and so on. The dancer 30 applies given tension to the filament 11 unwound from the bobbin 10. This embodiment shows an example where the piston 35, the air cylinder 36, and the air pipe 37 are included in a structure that applies tension, but tension may be applied by different structures. The support member 33 provides a fulcrum of the dancer arm 31 that is supported to be able to oscillate. The dancer arm 31 is able to oscillate (vertically in an example shown in FIG. 1) with a point supported by the support member as the fulcrum. The dancer roller 32, which is supported to be able to rotate, is mounted on a distal end of the dancer arm 31. The piston 35 housed in the air cylinder 36 is connected with the dancer arm 31, and air is supplied to the air cylinder 36 at given pressure from the air pipe 37. With this structure, the dancer 30 is able to apply given (certain) tension to the filament 11. The oscillation angle detection device 34 (such as an oscillation angle sensor) outputs a detection signal corresponding to an angular position of the dancer arm 31 to the control device 60.

A tension detection device (such as a tension sensor) and a speed detection device (such as an encoder) (not shown), for example, are connected with the measuring roller 40, and output detection signals to the control device 60. The active dancer roller 50 moves (vertically in the example in FIG. 1) based on a control signal from the control device 60 so as to correct a tracking delay (oscillation delay) of the dancer 30, and assists application of given (certain) tension to the filament 11. The control device 60 takes in a detection signal from the rotation detection device 23, a detection signal from the oscillation angle detection device 34, detection signals from a tension detection device and a speed detection device of the measuring roller 40, and an input from the input device 61, and outputs control signals to the bobbin rotation driving device 20, the active dancer roller 50, the display device 62, and a compressor (not shown) that supplies air to the air cylinder 36. A personal computer, for example, may be used for the control device 60, the input device 61, and the display device 62.

In a state where filament is unwound from a bobbin on which the filament is wound, the conventional filament winding apparatus obtains a bobbin diameter, which is a diameter of a point of the filament wound on the bobbin, as appropriate from speed of the unwound filament, rotation speed of the bobbin, and so on, and displays a remaining amount of the filament, and so on. However, in the state where a new bobbin 10 is mounted on the bobbin rotation driving device, neither the unwinding speed nor the bobbin rotation speed is not detected. Therefore, it is not possible to obtain the bobbin diameter from the unwinding speed and the bobbin rotation speed. Hence, conventionally, an operator needs to measure the bobbin diameter, which is a diameter of a point where the filament is wound on the mounted bobbin 10, and input the bobbin diameter from the input device. The control device displays a remaining amount of the filament on a display device based on the inputted bobbin diameter, sets initial parameters for controlling rotation speed of the bobbin rotation driving device at appropriate rotation speed based on the inputted bobbin diameter and the set unwinding speed, and so on. Since the bobbin diameter, which is measured when a new bobbin is mounted, is measured by an operator by using a caliper or the like, efforts and time are required, and accuracy of measurement results vary. In the filament winding method and the filament winding apparatus according to the invention, it is not necessary to newly provide a bobbin diameter measuring device at a position where a bobbin is mounted, and it is possible to obtain a bobbin diameter automatically when a new bobbin is mounted. Thus, efforts and time required by an operator are reduced, and a reduction in variation in measured bobbin diameters and an improvement in accuracy of measured bobbin diameters are expected.

Figure 2A:
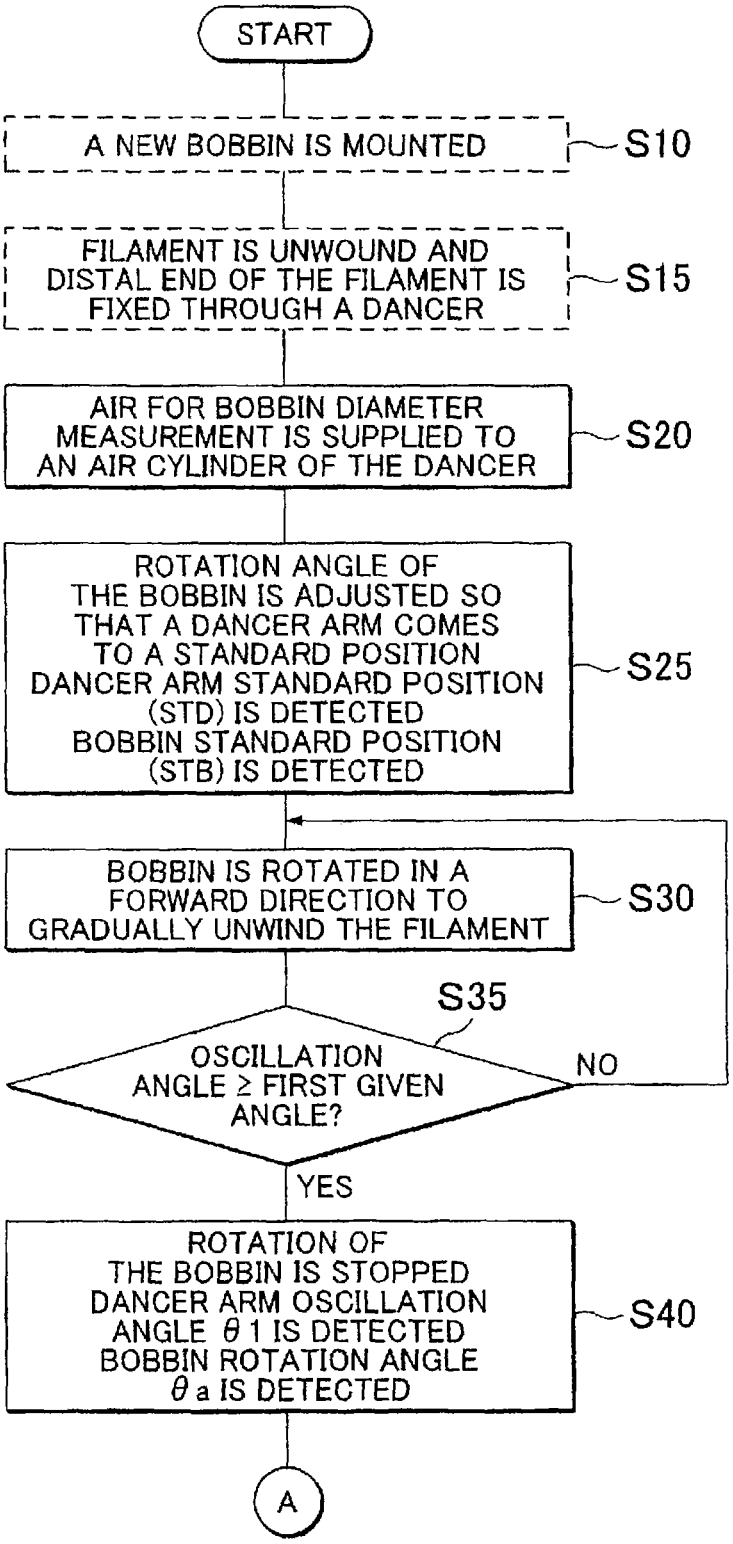
FIG. 2A and FIG. 2B are flowcharts explaining an example of processing steps of measurement of a bobbin diameter in a filament winding method when a new bobbin is mounted.
Figure 2B:
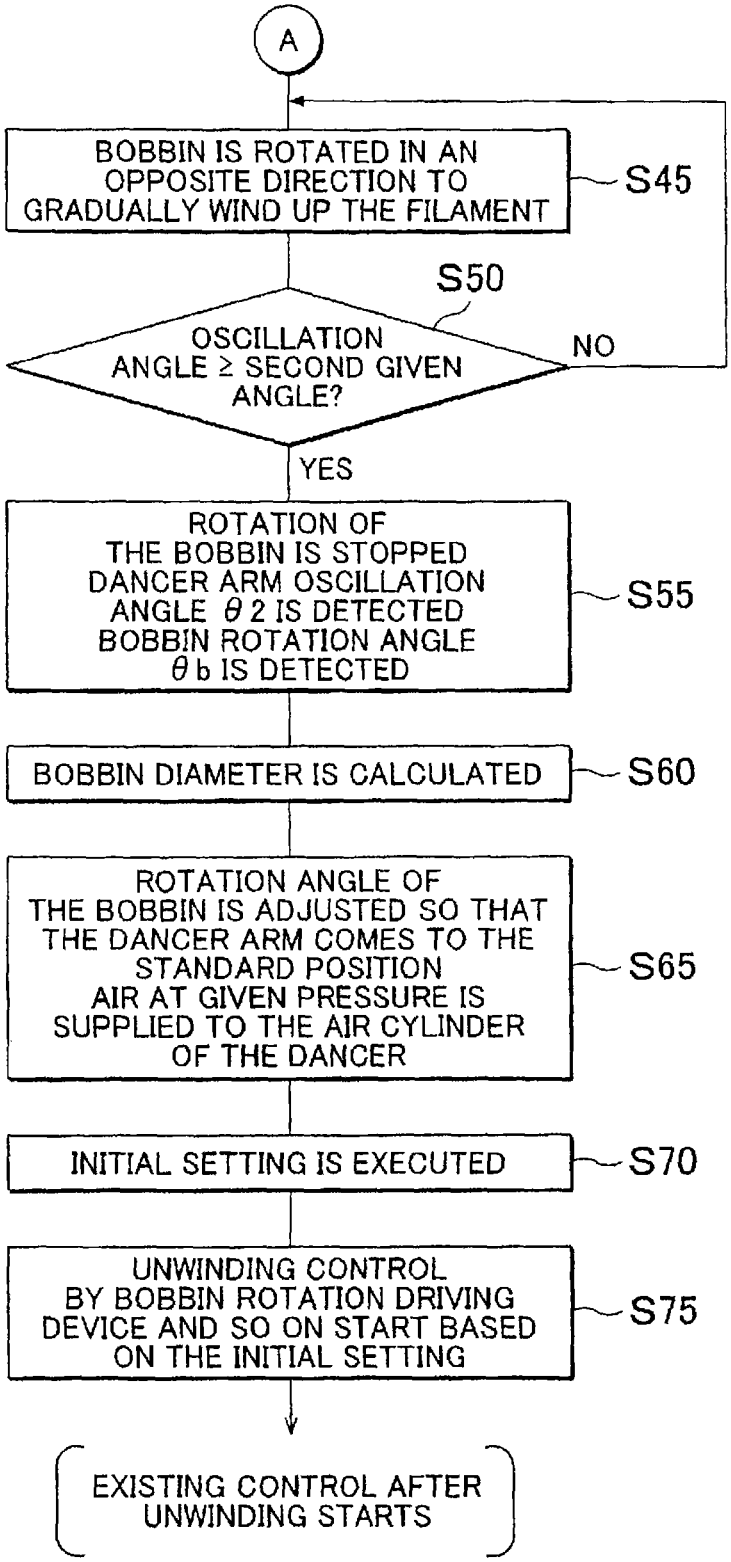
Figure 3A:
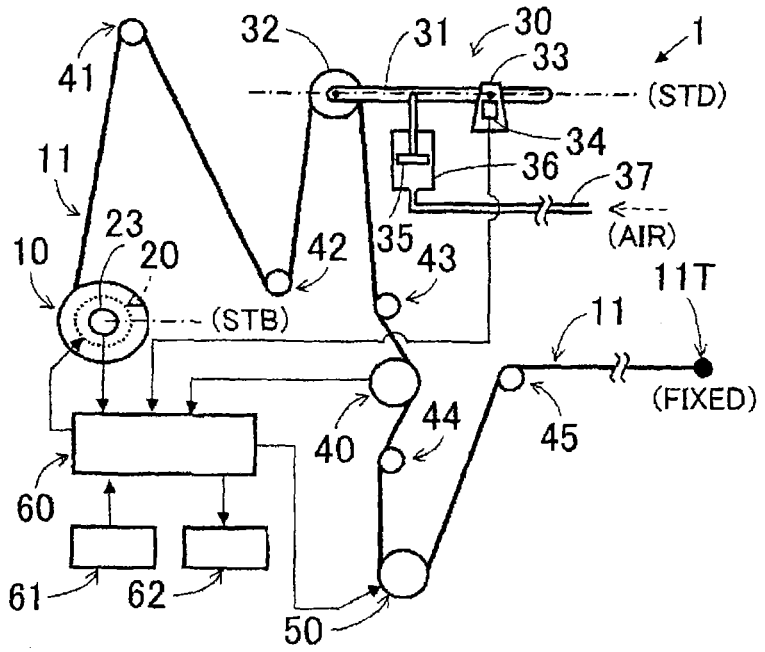
FIG. 3A is a view showing a state where a bobbin is rotated so that a position of a dancer becomes a standard position when measuring a bobbin diameter.

Next, processing steps for measuring a bobbin diameter when a new bobbin is mounted are explained by using flowcharts shown in FIGS. 2A and 2B. While carrying out the processing for measuring the bobbin diameter, an operation of the active dancer roller 50 is stopped. In step S10, in a case where filament wound on a bobbin mounted on a filament winding apparatus is finished (or immediately before finished), an operator stops the apparatus temporality, removes the bobbin after the filament is finished (or immediately before finished), and mounts a new bobbin. Then, in step S15, the operator causes the filament, which has been drawn out from the bobbin mounted on the filament winding apparatus (the bobbin rotation driving device), to pass through the guide roller 41, the guide roller 42, the dancer roller 32, the guide roller 43, the measuring roller 40, the guide roller 44, the active dancer roller 50, and the guide roller 45, and then causes a distal end of the filament 11 to be connected and fixed to a connecting point 11T (such as an object to be wound upon) as shown in FIG. 3A. Then, when the operator inputs an instruction from the input device to instruct that the bobbin has been changed, the control device 60 automatically carries out processing of the step S20 and later. The processing of steps S10, S15 stated above was explained as processing carried out by an operator, but may also be carried out automatically.

In step S20, as shown in FIG. 3A, the control device 60 supplies air, which is set at pressure for bobbin diameter measurement (pressure lower than pressure that is set when forming a reinforcing fiber preform), to the air cylinder 36 of the dancer 30 and operates the dancer 30 to apply tension to the filament 11. Thus, the filament 11 is made taut without being loosened. Then, the processing moves to step S25. In step S25, the control device 60 rotates the bobbin 10 by controlling the bobbin rotation driving device 20 so that an oscillating position of the dancer arm 31 becomes a dancer arm standard position (STD) (in this case, a horizontal position) as shown in FIG. 3A. Then, the control device 60 takes in a detection signal from the oscillation angle detection device 34 shown in FIG. 3A, detects and stores an oscillation angle of the dancer arm standard position (STD), takes in a detection signal from the rotation detection device 23, and detects and stores a rotation angle of the bobbin standard position (STB). The processing then moves to step S30.

In step S30, the control device 60 takes in a detection signal from the oscillation angle detection device 34. The control device 60 then outputs a control signal to the bobbin rotation driving device 20 while detecting an oscillation angle of the dancer arm 31 so as to gradually rotate the bobbin 10 in a forward direction (a direction for unwinding the filament, which is a clockwise direction in the example in FIG. 3B). Thus, the filament 11 is unwound little by little, and the dancer arm 31 is oscillated upwardly. Then, the processing moves to step S35. In step S35, the control device 60 determines whether or not the oscillation angle of the dancer arm has reached a first given angle or more (in the forward direction). In the case where the oscillation angle has reached the first given angle or more (in the forward direction) (Yes), the processing moves on to the step S40. In the case where the oscillation angle has not reached the first given angle (in the forward direction) (No), the processing returns to the step S30. The first given angle is an angle corresponding to one end or the vicinity of the one end of an oscillation range of the dancer arm 31. In the case where the processing moves to the step S40, the dancer 30 and the bobbin 10 are in the states shown in FIG. 3B. In step S40, the control device 60 stops an operation of the bobbin rotation driving device 20, detects an oscillation angle of the dancer arm 31 based on a detection signal from the oscillation angle detection device 34, and detects a rotation angle of the bobbin based on a detection signal from the rotation detection device 23. Then, the control device 60 calculates and stores an oscillation angle θ1 (see FIG. 3B), which is a difference between the oscillation angle of the dancer arm 31 detected in step S40 and the oscillation angle of the dancer arm standard position (STD) detected in step S25. The control device 60 also calculates and stores a rotation angle θa (see FIG. 3B), which is a difference between the rotation angle of the bobbin detected in step S40 and the rotation angle of the bobbin standard position (STB) detected in step S25. Then, the processing moves on to step S45.

Figure 4A:
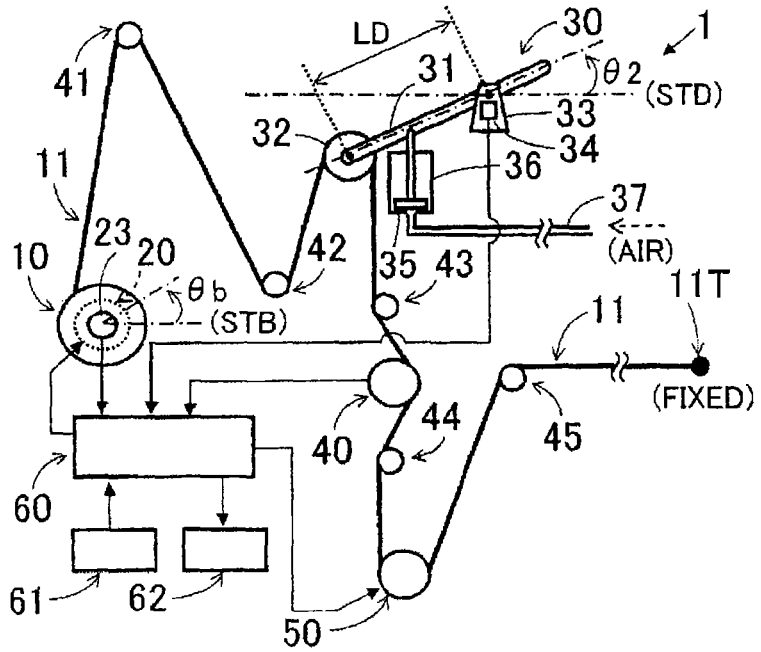
FIG. 4A is a view showing a state where the bobbin is rotated so that the dancer oscillation angle is at the other end (or the vicinity of the other end) of the oscillation range when measuring the bobbin diameter.

In step S45, while taking in a detection signal from the oscillation angle detection device 34 and detecting an oscillation angle of the dancer arm 31, the control device 60 outputs a control signal to the bobbin rotation driving device 20 and gradually rotates the bobbin 10 in an opposite direction (in a direction of winding up the filament, which is a counterclockwise direction in the example shown in FIG. 4A) to wind up the filament 11 little by little and oscillate the dancer arm 31 downwardly. Then, the processing moves on to step S50. In step S50, the control device 60 determines whether of not an oscillation angle of the dancer arm has reached a second given angle or more (in the opposite direction). In the case where the oscillation angle has reached the second given angle or more (in the opposite direction) (Yes), the processing moves on to step S55. In the case where the oscillation angle has not reached the second given angle (in the opposite direction) (No), the processing returns to step S45. The second given angle is an angle corresponding to the other end or the vicinity of the other end of the oscillation range of the dancer arm 31. In the case where the processing moves to step S55, the dancer 30 and the bobbin 10 are in the states shown in FIG. 4A. In step S55, the control device 60 stops an operation of the bobbin rotation driving device 20, detects an oscillation angle of the dancer arm 31 based on a detection signal from the oscillation angle detection device 34, and detects a rotation angle of the bobbin based on a detection signal from the rotation detection device 23. Then, the control device 60 calculates and stores an oscillation angle θ2 (see FIG. 4A), which is a difference between the oscillation angle of the dancer arm 31 detected in step S55 and the oscillation angle of the dancer arm standard position (STD) detected in step S25. The control device 60 also calculates and stores a rotation angle θb (see FIG. 4A), which is a difference between the rotation angle of the bobbin detected instep S55 and the rotation angle of the bobbin standard position (STB) detected in step S25. Then, the processing moves on to step S60.

Figure 3B:
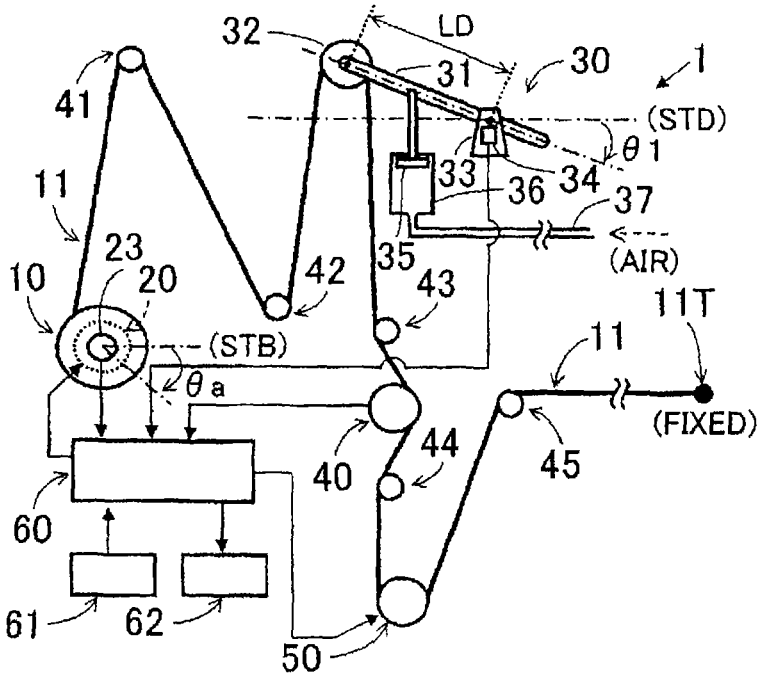
FIG. 3B is a view showing a state where the bobbin is rotated so that a dancer oscillation angle is at one end (or the vicinity of the one end) of an oscillation range when measuring the bobbin diameter.

In step S60, the control device 60 calculates a bobbin diameter, which is a diameter of a point where the filament is wound on the bobbin 10, by using (Equation 1) stated below based on the oscillation angles θ1, θ2 of the dancer arm 31, the rotation angles θa, θb of the bobbin, and a length LD of the dancer arm (see FIG. 3B, and FIG. 4A). Then, the processing moves on to step S65. If a radius of the bobbin is Rx, and a rotation angle of the bobbin (θa+θb)=θc, the following equation is obtained.

A length of filament unwound by rotation of the bobbin ($LX$)=a length of filament unwound by oscillation of the dancer arm ($LY$)

$$LX=2\pi Rx*\theta c/360 \quad LY=2*LD*[\sin(\theta 1)+\sin(\theta 2)]$$

Since LX=LY, $$2\pi Rx*\theta c/360=2*LD*[\sin(\theta 1)+\sin(\theta 2)]$$

Therefore, bobbin diameter (radius)=$Rx=360*LD*[\sin(\theta 1)+\sin(\theta 2)]/(\pi*\theta c)$ (Equation 1)

As another method for calculating a bobbin diameter (radius) in (Equation 1) stated above, a map of a bobbin diameter based on a rotation angle of the bobbin, an oscillation angle of the dancer arm, and a length of the dancer arm, and so on may be stored previously in the control device that is connected to the control device, and the bobbin diameter may be obtained based on the previously-known length of the dancer arm, the rotation angle of the bobbin and the oscillation angle of the dancer arm that have been obtained, the map, and so on.

Figure 4B:
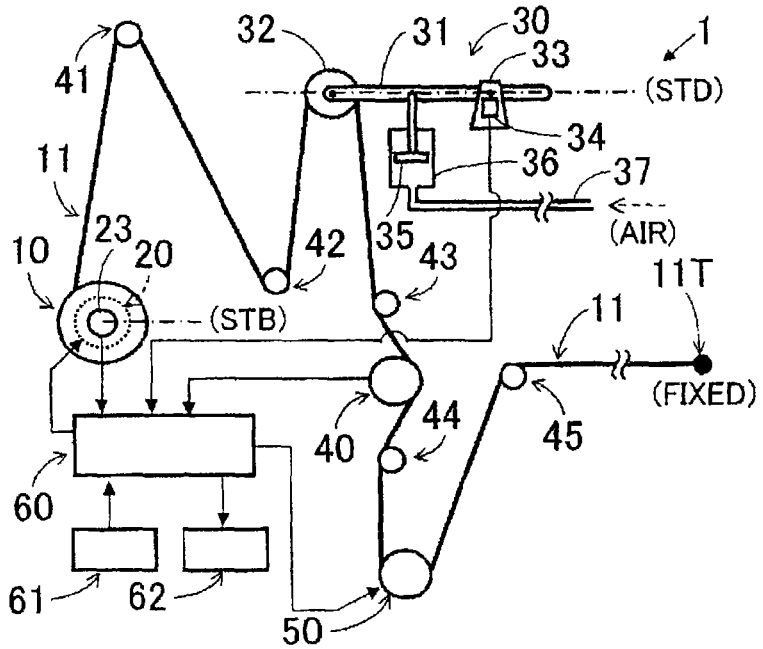
FIG. 4B is a view showing a state where the bobbin is rotated so that the position of the dancer becomes the standard position when measuring the bobbin diameter.
Figure 5:
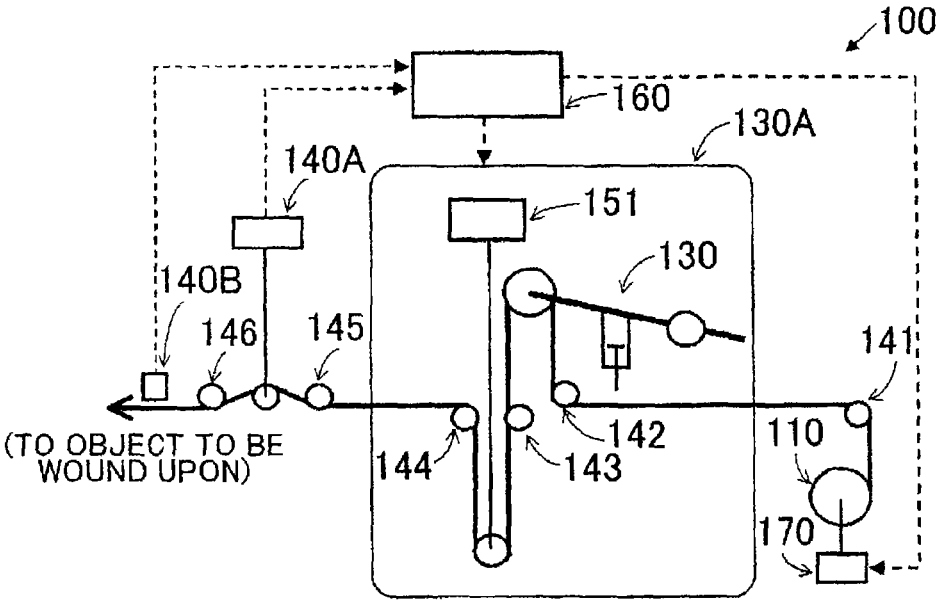
FIG. 5 RELATED ART
FIG. 5 is a view for explaining an example of a conventional filament winding apparatus.

In step S65, the control device 60 controls the bobbin rotation driving device 20 to rotate the bobbin 10 so that an oscillating position of the dancer arm 31 becomes the dancer arm standard position (STD) as shown in FIG. 4B. Then, air is supplied to the air cylinder 36 at given pressure in order to apply tension for forming a reinforcing fiber preform. Then, the processing moves on to step S70. In step S70, the control device 60 executes initial settings and so on, and moves on to step S75. For example, the control device 60 causes the display device to display a remaining amount of filament based on the bobbin diameter obtained (display of a remaining amount), sets initial parameters for controlling the bobbin rotation driving device based on the set unwinding speed and obtained bobbin diameter, and so on. The control device 60 may automatically carry out at least either display of a remaining amount or setting of the initial parameters. In step S75, the control device 60 starts controlling the bobbin rotation driving device based on the initial parameters set in step S70 and starts controlling unwinding of the filament. The processing thereafter is similar to existing control without the automatic calculation of a bobbin diameter. Therefore, explanation is omitted.

By carrying out the filament winding method explained in the embodiment above, it is possible to calculate a bobbin diameter automatically when a new bobbin is mounted. Further, it is not necessary to newly add a bobbin diameter detection device. Therefore, it is possible to cut efforts and time required by an operator, and carry out operations for forming a reinforcing fiber preform more efficiently. Compared to the related art in which an operator measures a bobbin diameter by using a caliper or the like, a reduction in variation of measured bobbin diameters, and an improvement in accuracy of measured bobbin diameters are expected. At the same time, since it is not necessary to newly add a bobbin diameter detection device, it is possible to suppress an increase in costs. By oscillating the dancer arm in a larger an angle range within the oscillation range, it is possible to obtain a more accurate bobbin diameter. After a bobbin diameter is obtained automatically, at least either display of a remaining amount of filament or setting of initial parameters is carried out automatically by using the obtained bobbin diameter. Therefore, efforts and time required by an operator are reduced, and input errors by an operator are avoided. Therefore, operations for forming a reinforcing fiber preform are carried out more efficiently. The filament winding apparatus for carrying out the filament winding method explained by using the flowcharts in FIGS. 2A and 2B are realized with the structure shown in FIG. 1.

Various changes, additions, deletions may be made in the processing, structure, construction, shape, and so on of the filament winding method and the filament winding apparatus 1 according to the invention without departing from the gist of the invention. Symbols for "greater than or equal to" (≥), "less than or equal to" (≤), "greater than" (>), "less than" (<), and so on may or may not include the equal sign.

What is claimed is:

1. A filament winding method including: a bobbin rotation driving device, on which a bobbin, upon which filament is wound, is mounted, the bobbin rotation driving device driving and rotating the bobbin, a dancer that oscillates in order to apply certain tension to the filament unwound from the bobbin, and a control device that is programmed to control the bobbin rotation driving device, the filament winding method comprising:

when a new bobbin is mounted on the bobbin rotation driving device, oscillating the dancer by rotating a bobbin by using the control device while maintaining a state where a distal end of the filament unwound through the dancer is fixed further beyond the dancer and the unwound filament is stretched; and obtaining a bobbin diameter of the bobbin mounted on the bobbin rotation driving device, by using the control device, based on a length of the dancer, an oscillation angle of the dancer, and a rotation angle of the bobbin.

2. The filament winding method according to claim 1, wherein the dancer is oscillated from one end or the vicinity of the one end of an oscillation range to the other end or the vicinity of the other end of the oscillation range when the bobbin diameter is obtained.

3. The filament winding method according to claim 1, wherein the control device is programmed to automatically carry out at least either display of a remaining amount of the filament, or setting of an initial parameter when unwinding by the bobbin rotation driving device begins, based on the bobbin diameter obtained.

4. The filament winding method according to claim 1, further comprising:

detecting the oscillation angle of the dancer during the oscillating the dancer with an oscillation angle detection device, and obtaining the bobbin diameter of the bobbin mounted on the bobbin rotation driving device, by using the control device, based on the length of the dancer, the detected oscillation angle of the dancer, and the rotation angle of the bobbin.

5. The filament winding method according to claim 1, wherein the oscillating the dancer includes oscillating the dancer in a first direction by rotating the bobbin in a forward direction unwinding the filament, and oscillating the dancer in a second direction opposite to the first direction by rotating the bobbin in a backward direction upwinding the filament, and the obtaining the bobbin diameter includes obtaining the bobbin diameter, by using the control device, based on the length of the dancer, oscillation angles of the dancer in the first and second directions, and rotation angles of the bobbin in the forward and backward directions.

6. A filament winding apparatus comprising:

a bobbin rotation driving device, on which a bobbin, upon which filament is wound, is mounted, the bobbin rotation driving device driving and rotating the bobbin, a rotation angle detection device that detects a rotation angle of the bobbin rotation driving device, a dancer that oscillates in order to apply certain tension to the filament unwound from the bobbin, an oscillation angle detection device that detects an oscillation angle of the dancer, and a control device that is programmed to control the bobbin rotation driving device, wherein, when a new bobbin is mounted on the bobbin rotation driving device, the filament winding apparatus maintains a state where a distal end of the filament unwound through the dancer is fixed further beyond the dancer and the unwound filament is stretched, and the control device is programmed to rotate the bobbin and oscillate the dancer, and the control device is programmed to calculate a bobbin diameter of the bobbin mounted on the bobbin rotation driving device based on a rotation angle of the bobbin rotation driving device based on a detection signal from the rotation angle detection device, an oscillation angle of the dancer based on a detection signal from the oscillation angle detection device, and a length of the dancer.

7. The filament winding apparatus according to claim 6, wherein, when obtaining the bobbin diameter, the control device is programmed to control the bobbin rotation driving device while taking in the detection signal from the oscillation angle detection device, and oscillate the dancer from one end or the vicinity of the one end of an oscillation range to the other end or the vicinity of the other end of the oscillation range.

8. The filament winding apparatus according to claim 6, wherein the control device is programmed to automatically carry out at least either display of a remaining amount of the filament, or setting of an initial parameter when unwinding by the bobbin rotation driving device begins, based on the calculated bobbin diameter.

9. The filament winding apparatus according to claim 6, wherein the control device is programmed to when the new bobbin is mounted on the bobbin rotation driving device, oscillate the dancer in a first direction by rotating the bobbin in a forward direction unwinding the filament, and oscillate the dancer in a second direction opposite to the first direction by rotating the bobbin in a backward direction upwinding the filament, and the control device is programmed to calculate the bobbin diameter based on the length of the dancer, oscillation angles of the dancer in the first and second directions, and rotation angles of the bobbin in the forward and backward directions.

* * * * *